US009280923B2

(12) United States Patent
Chen et al.

(10) Patent No.: US 9,280,923 B2
(45) Date of Patent: Mar. 8, 2016

(54) DISPLAY DEVICE OPERATING IN 2D AND 3D DISPLAY MODES AND METHOD FOR DRIVING THE SAME

(71) Applicant: InnoLux Corporation, Miao-Li County (TW)

(72) Inventors: Chien-Hung Chen, Miao-Li County (TW); Ying-Jen Chen, Miao-Li County (TW)

(73) Assignee: InnoLux Corporation, Miaoli County (TW)

( * ) Notice: Subject to any disclaimer, the term of this patent is extended or adjusted under 35 U.S.C. 154(b) by 178 days.

(21) Appl. No.: 13/940,482

(22) Filed: Jul. 12, 2013

(65) Prior Publication Data

US 2014/0022286 A1 Jan. 23, 2014

(30) Foreign Application Priority Data

Jul. 18, 2012 (TW) ..... 101125738 A

(51) Int. Cl.
*G09G 3/20* (2006.01)
*G09G 3/00* (2006.01)

(52) U.S. Cl.
CPC ..... *G09G 3/2003* (2013.01); *G09G 3/003* (2013.01)

(58) Field of Classification Search
None
See application file for complete search history.

(56) References Cited

U.S. PATENT DOCUMENTS

2012/0019754 A1* 1/2012 Ting et al. ..... 349/123
2012/0120058 A1* 5/2012 Lee et al. ..... 345/419
2012/0256977 A1* 10/2012 Jeong et al. ..... 345/691
2012/0262430 A1* 10/2012 Ho ..... G02F 1/13624 345/204
2013/0009941 A1* 1/2013 Hwang et al. ..... 345/212
2013/0044090 A1* 2/2013 Wu et al. ..... 345/204
2013/0128166 A1* 5/2013 Chiang ..... G02F 1/1362 349/38

FOREIGN PATENT DOCUMENTS

CN 102402026 A 4/2012

* cited by examiner

*Primary Examiner* — Kent Chang
*Assistant Examiner* — Benjamin Morales Fernande

(57) ABSTRACT

A display device includes a first scan line, a second scan line, a third scan line, a data line, a pixel, a low color-shifting circuit, and a black zone generation circuit. In the low color-shifting circuit, a low color-shifting switch receives a third scan signal from the third scan line to selectively couple a compensating capacitor to the second sub-pixel electrode. The black zone generation circuit receives a black zone generation signal to selectively couple either the first sub-pixel electrode or the second sub-pixel electrode to a common node such that either the first sub-pixel or the second sub-pixel becomes a black zone.

5 Claims, 5 Drawing Sheets

DISPLAY DEVICE OPERATING IN 2D AND 3D DISPLAY MODES AND METHOD FOR DRIVING THE SAME

CROSS REFERENCE TO RELATED APPLICATIONS

This Application claims priority of Taiwan Patent Application No. 101125738 filed on Jul. 18, 2012, the entirety of which is incorporated by reference herein.

BACKGROUND

1. Field of the Invention

The disclosure generally relates to a display device, and more particularly to a display device with 2D (two-dimensional) and 3D (three-dimensional) display modes and a method for driving the same.

2. Description of the Related Art

Nowadays, 3D display technology generates 3D images by using a change in the viewing angle of a user. A traditional 3D display device comprises black matrices, which are made of opaque material and located between pixels, to reduce crosstalk between the pixels. However, these black matrices shelter a part of output light generated by the pixels and degrade the efficiency of the display device generating light. Accordingly, if a display device with a black matrix is configured to display 2D images, the screen may be too dark.

BRIEF SUMMARY

In a preferred embodiment, the disclosure is directed to a display device, comprising: a first scan line; a second scan line; a third scan line; a data line; a first pixel, comprising: a first sub-pixel, comprising: a first sub-pixel electrode; and a first switch, receiving a second scan signal from the second scan line to selectively couple the data line to the first sub-pixel electrode; and a second sub-pixel, comprising: a second sub-pixel electrode; and a second switch, receiving the second scan signal from the second scan line to selectively couple the data line to the second sub-pixel electrode; a low color-shifting circuit, comprising: a compensating capacitor; and a low color-shifting switch, receiving a third scan signal from the third scan line to selectively couple the compensating capacitor to the second sub-pixel electrode of the second sub-pixel; and a black zone generation circuit, receiving a black zone generation signal to selectively couple either the first sub-pixel electrode or the second sub-pixel electrode to a common node such that either the first sub-pixel or the second sub-pixel becomes a black zone.

In some embodiments, the black zone generation circuit comprises a black zone switch having a control terminal, a first terminal and a second terminal, wherein the control terminal is coupled to the first scan line, the first terminal is coupled to the first sub-pixel electrode, and the second terminal is coupled to the common node.

In some embodiments, the disclosure is directed to a method for driving a display device as mentioned above, wherein: in a 3D (three-dimensional) display mode, the following steps are performed sequentially: outputting the third scan signal to the third scan line; outputting the second scan signal to the second scan line such that the data of the data line is input to the first sub-pixel and the second sub-pixel; and outputting a first scan signal to the first scan line, wherein the first scan signal is the black zone generation signal such that the first sub-pixel becomes the black zone. In a 2D (two-dimensional) display mode, the following steps are performed sequentially: outputting the first scan signal to the first scan line; outputting the second scan signal to the second scan line such that the data of the data line is input to the first sub-pixel and the second sub-pixel; and outputting the third scan signal to the third scan line such that a liquid-crystal capacitor of the second sub-pixel shares charges with the compensating capacitor.

In some embodiments, the display device further comprises: a fourth scan line; a fifth scan line; and a second pixel, comprising: a third sub-pixel, comprising: a third sub-pixel electrode; and a third switch, receiving a fourth scan signal from the fourth scan line to selectively couple the data line to the third sub-pixel electrode; and a fourth sub-pixel, comprising: a fourth sub-pixel electrode; and a fourth switch, receiving the fourth scan signal from the fourth scan line to selectively couple the data line to the fourth sub-pixel electrode, wherein the black zone generation circuit comprises a black zone switch having a control terminal, a first terminal and a second terminal, wherein the control terminal is coupled to the fourth scan line to receive the fourth scan signal, the first terminal is coupled to the second sub-pixel electrode, and the second terminal is coupled to the common node.

In some embodiments, the disclosure is directed to a method for driving a display device as mentioned above, wherein: in a 3D (three-dimensional) display mode, the following steps are performed sequentially: outputting the second scan signal to the second scan line such that the data of the data line is input to the first sub-pixel and the second sub-pixel; and outputting the fourth scan signal to the fourth scan line such that the data of the data line is input to the third sub-pixel and the fourth sub-pixel, wherein the fourth scan signal is the black zone generation signal such that the second sub-pixel becomes the black zone. In a 2D (two-dimensional) display mode, the following steps are performed sequentially: outputting the fourth scan signal to the fourth scan line such that the data of the data line is input to the third sub-pixel and the fourth sub-pixel; outputting a fifth scan signal and the second scan signal to the fifth scan line and the second scan line, respectively, such that a capacitor of the fourth sub-pixel shares charges with the compensating capacitor and the data of the data line is input to the first sub-pixel and the second sub-pixel; and outputting the third scan signal to the third scan line such that a liquid-crystal capacitor of the second sub-pixel shares charges with the compensating capacitor.

BRIEF DESCRIPTION OF DRAWINGS

The invention can be more fully understood by reading the subsequent detailed description and examples with references made to the accompanying drawings, wherein.

DETAILED DESCRIPTION

In order to illustrate the purposes, features and advantages of the invention, the embodiments and figures of the invention are shown in detail as follows.

Figure 1A:
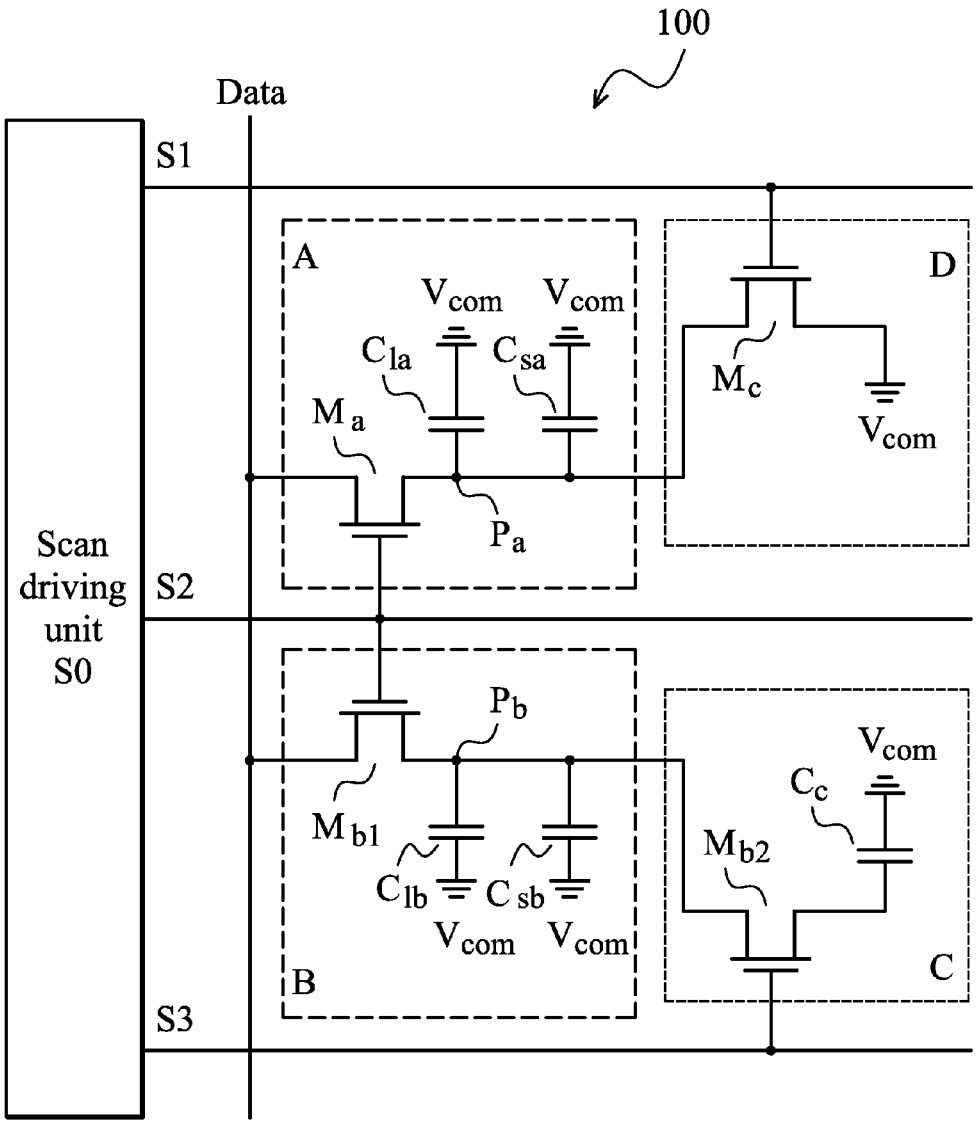
FIG. 1A is a diagram for illustrating a part of the circuitry of a display device according to an embodiment of the invention.

FIG. 1A is a diagram for illustrating a part of the circuitry of a display device 100 (e.g., a liquid-crystal display) according to an embodiment of the invention. The display device 100 comprises a scan driving unit S0, a data line Data, a first scan line S1, a second scan line S2, and a third scan line S3. The scan driving unit S0 transmits a first scan signal, a second scan signal, and a third scan signal to the first scan line S1, the second scan line S2, and the third scan line S3, respectively, so as to control the corresponding circuits in the display device 100. The data line Data receives image data and transmits the image data to the corresponding pixels in the display device 100.

The display device 100 further comprises a first sub-pixel A and a second sub-pixel B of a first pixel. The first sub-pixel A comprises a liquid-crystal capacitor $C_{1a}$, a storage capacitor $C_{sa}$, and a first switch $M_a$. To simplify the drawing, the storage capacitor $C_{sa}$ is not shown in FIG. 1A. In the embodiment, the first switch $M_a$ is a thin-film transistor, which has a gate coupled to the second scan line S2, a source/drain coupled to the data line Data, and another source/drain coupled to a first sub-pixel electrode $P_a$. A terminal of the liquid-crystal capacitor $C_{1a}$ is coupled to a common node $V_{com}$. A terminal of the storage capacitor $C_{sa}$ is coupled to the first sub-pixel electrode $P_a$, and another terminal thereof is coupled to the common node $V_{com}$.

The second sub-pixel B comprises a liquid-crystal capacitor $C_{1b}$, a storage capacitor $C_{sb}$, and a second switch $M_{b1}$. In the embodiment, the second switch $M_{b1}$ is a thin-film transistor, which has a gate coupled to the second scan line S2, a source/drain coupled to the data line Data, and another source/drain coupled to a second sub-pixel electrode $P_b$. A terminal of the liquid-crystal capacitor $C_{1b}$ is coupled to the common node $V_{com}$. A terminal of the storage capacitor $C_{sb}$ is coupled to the second sub-pixel electrode $P_b$, and another terminal thereof is coupled to the common node $V_{com}$.

When the second scan line S2 receives the second scan signal from the scan driving unit S0, the first switch $M_a$ and the second switch $M_{b1}$ are turned on such that the data of the data line Data is input to the storage capacitor $C_{sa}$ of the first sub-pixel A and the storage capacitor $C_{sb}$ of the second sub-pixel B.

The display device 100 of FIG. 1A further comprises a low color-shifting circuit C and a black zone generation circuit D. The low color-shifting circuit C comprises a compensating capacitor $C_c$ and a low color-shifting switch $M_{b2}$. In the embodiment, the low color-shifting switch $M_{b2}$ is a thin-film transistor, which has a gate coupled to the third scan line S3, a source/drain coupled to the second sub-pixel electrode $P_b$, and another source/drain coupled to a terminal of the compensating capacitor $C_c$. Another terminal of the compensating capacitor $C_c$ is coupled to the common node $V_{com}$. However, the invention is not limited to the above. The low color-shifting switch $M_{b2}$ may be any device configured to selectively couple the second sub-pixel electrode $P_b$ to a terminal of the compensating capacitor $C_c$ according to the third scan signal of the third scan line S3. When the third scan line S3 of the display device 100 receives the third scan signal, the low color-shifting switch $M_{b2}$ of the low color-shifting circuit C is turned on such that the second sub-pixel electrode $P_b$ of the second sub-pixel B is coupled to the compensating capacitor $C_c$ and that the storage capacitor $C_{sb}$ shares charges with the compensating capacitor $C_c$. Accordingly, the light output rate of the second sub-pixel B is decreased.

The black zone generation circuit D comprises a black zone switch $M_c$. In the embodiment, the black zone switch $M_c$ is a thin-film transistor, which has a gate coupled to the first scan line S1, a source/drain coupled to the first sub-pixel electrode $P_a$, and another source/drain coupled to the common node $V_{com}$. However, the invention is not limited to the above. The black zone switch $M_c$ may be any device configured to selectively couple the first sub-pixel electrode $P_a$ to the common node $V_{com}$ according to the first scan signal of the first scan line S1. When the first scan line S1 receives the first scan signal, the black zone switch $M_c$ of the black zone generation circuit D is turned on such that the first sub-pixel electrode $P_a$ of the first sub-pixel A is coupled to the common node $V_{com}$ and that the data stored in the storage capacitor $C_{sa}$ is released. Accordingly, the first sub-pixel A becomes a black zone.

Figure 1B:
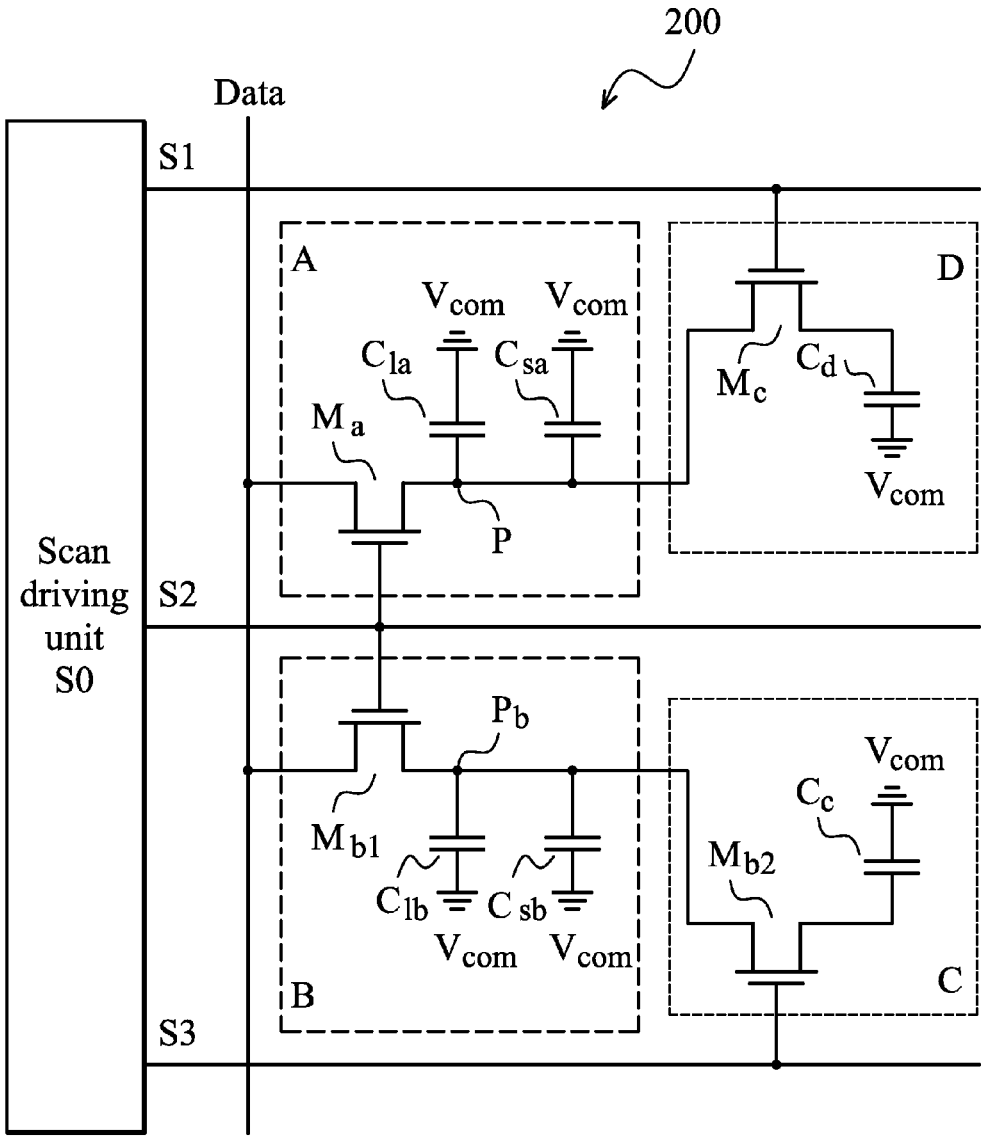
FIG. 1B is a diagram for illustrating a part of the circuitry of a display device according to another embodiment of the invention.

FIG. 1B is a diagram for illustrating a part of the circuitry of a display device 200 according to another embodiment of the invention. The difference between the embodiments in FIGS. 1A and 1B is that the black zone generation circuit D of FIG. 1B further comprises a black zone capacitor $C_d$. In the embodiment of FIG. 1B, a source/drain of the black zone switch $M_c$ is not directly connected to the common node $V_{com}$ but is coupled to a terminal of the black zone capacitor $C_d$. Another terminal of the black zone capacitor $C_d$ is coupled to the common node $V_{com}$. When the first scan line S1 of the display device 200 of FIG. 1B receives the first scan signal, the black zone switch $M_c$ of the black zone generation circuit D is turned on such that the first sub-pixel electrode $P_a$ of the first sub-pixel A is coupled to the black zone capacitor $C_d$ and that the storage capacitor $C_{sa}$ shares charges with the black zone capacitor $C_d$. Accordingly, the voltage of the first sub-pixel electrode $P_a$ is lower than a threshold voltage of the first sub-pixel A, and the first sub-pixel A becomes a black zone.

Figure 2A:
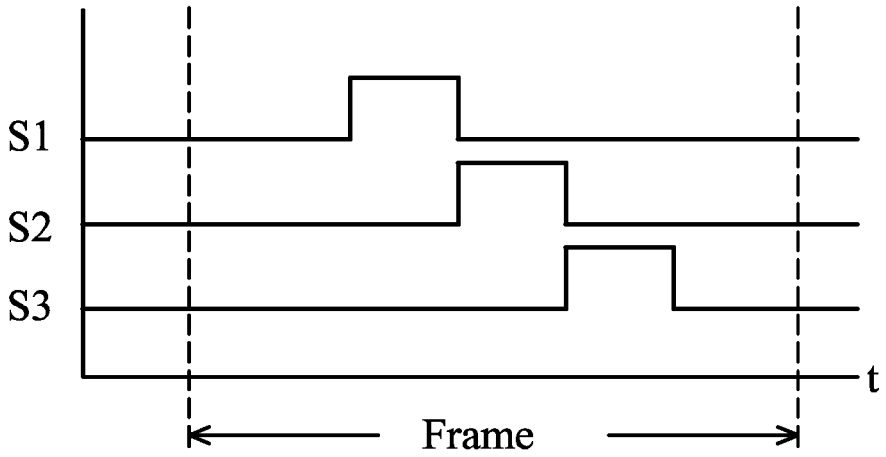
FIG. 2A is a diagram for illustrating a method for driving a display device according to an embodiment of the invention.
Figure 2B:
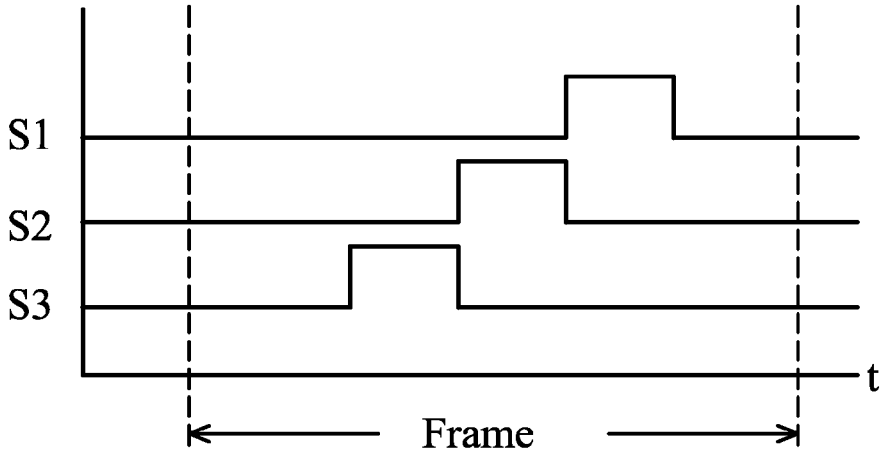
FIG. 2B is a diagram for illustrating a method for driving a display device according to another embodiment of the invention.

Two methods for driving the display devices in FIGS. 1A and 1B are disclosed as follows. Refer to FIGS. 2A and 2B. It is understood that the methods of FIGS. 2A and 2B correspond to the first scan line S1, the second scan line S2 and the third scan line S3 of the display devices 100 and 200 in FIGS. 1A and 1B. The invention is not limited to the above. A person of ordinary skill in the art can easily apply these embodiments to another display device with any number of scan lines.

When the display device 100 or 200 operates in a 2D (two-dimensional) display mode, the method for driving is shown in FIG. 2A. In a frame period, the following steps are included. To begin, the first scan signal is output to the first scan line S1 such that the black zone switch $M_c$ of the black zone generation circuit D is turned on and that the first sub-pixel electrode $P_a$ of the first sub-pixel A is coupled to the black zone capacitor $C_d$. The step resets the data stored in the liquid-crystal capacitor $C_{1a}$ of the first sub-pixel A in the previous frame, but does not affect image display in the current frame. Next, the first scan signal is stopped, and the second scan signal is output to the second scan line S2 such that the data of the data line Data is input to the storage capacitor $C_{sa}$ of the first sub-pixel A and the storage capacitor $C_{sb}$ of the second sub-pixel B. Then, the second scan signal is stopped, and the third scan signal is output to the third scan line S3 such that the second sub-pixel electrode $P_b$ of the second sub-pixel B is coupled to the compensating capacitor $C_c$ and that the storage capacitor $C_{sb}$ shares charges with the compensating capacitor $C_c$. Accordingly, the brightness of the first sub-pixel A is decreased, and the color-shifting effect for the display device 100 or 200 to display 2D image data is reduced.

When the display device 100 or 200 operates in a 3D (three-dimensional) display mode, the method for driving is shown in FIG. 2B. In a frame period, the following steps are included. To begin, the third scan signal is output to the third scan line S3 such that the low color-shifting switch $M_{b2}$ of the low color-shifting circuit C is turned on and that the second sub-pixel electrode $P_b$ of the second sub-pixel B is coupled to the compensating capacitor $C_c$. Since the liquid-crystal capacitor $C_{1b}$ of the second sub-pixel B still stores the image data in the previous frame, the step does not affect image display in the current frame. Next, the third scan signal is stopped, and the second scan signal is output to the second scan line S2 such that the data of the data line Data is input to the storage capacitor $C_{sa}$ of the first sub-pixel A and the storage capacitor $C_{sb}$ of the second sub-pixel B. Then, the second scan signal is stopped, and the first scan signal is output to the first scan line S1 such that the black zone switch $M_c$ of the black zone generation circuit D is turned on and that the storage capacitor $C_{sa}$ is discharged until the transmittance of the liquid crystals of the first sub-pixel A becomes zero. Accordingly, the first sub-pixel A becomes a black zone.

Figure 3:
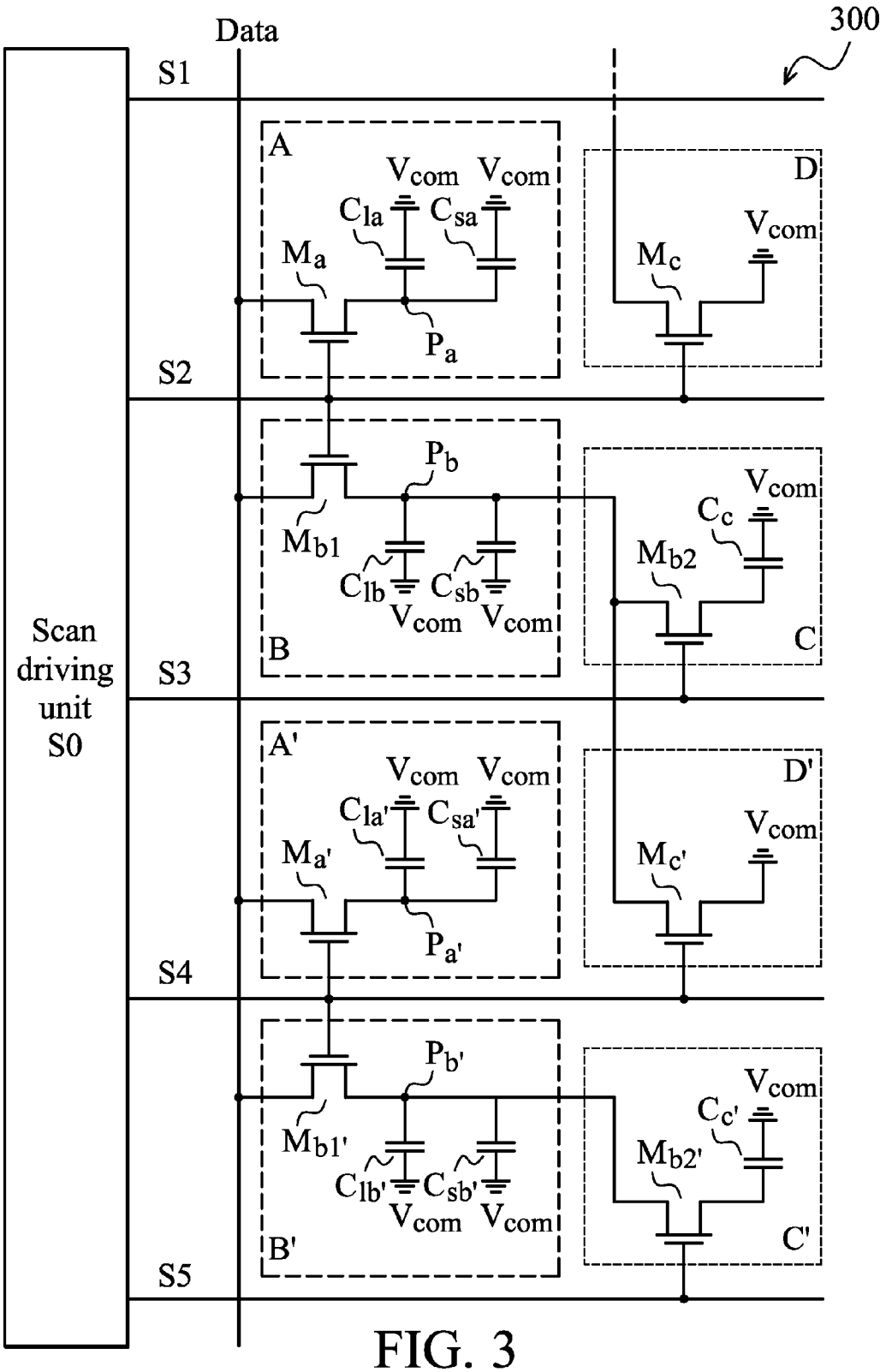
FIG. 3 is a diagram for illustrating a part of the circuitry of a display device according to an embodiment of the invention.

FIG. 3 is a diagram for illustrating a part of the circuitry of a display device 300 according to an embodiment of the invention. The display device 300 comprises a scan driving unit S0, a data line Data, a first scan line S1, a second scan line S2, a third scan line S3, a fourth scan line S4, and a fifth scan line S5. The scan driving unit S0 transmits a first scan signal, a second scan signal, a third scan signal, a fourth scan signal, and a fifth scan signal to the first scan line S1, the second scan line S2, the third scan line S3, the fourth scan line S4, and the fifth scan line S5, respectively, so as to control the corresponding circuits in the display device 300. The data line Data receives image data and transmits the image data to the corresponding pixels in the display device 300.

The display device 300 comprises the first sub-pixel A and the second sub-pixel B that have been described in the embodiments of FIGS. 1A and 1B. When the second scan line S2 receives the second scan signal from the scan driving unit S0, the first switch $M_a$ and the second switch $M_{b1}$ are turned on such that the data of the data line Data is input to the storage capacitor $C_{sa}$ of the first sub-pixel A and the storage capacitor $C_{sb}$ of the second sub-pixel B.

The display device 300 further comprises a third sub-pixel A' and a fourth sub-pixel B' of a second pixel that are similar to the first sub-pixel A and the second sub-pixel B. When the fourth scan line S4 receives the fourth scan signal from the scan driving unit S0, the third switch $M_a'$ and the fourth switch $M_{b1}'$ are turned on such that the data of the data line Data is input to a storage capacitor $C_{sa}'$ of the third sub-pixel A' and a storage capacitor $C_{sb}'$ of the fourth sub-pixel B'.

The display device 300 further comprises low color-shifting circuits C and C' that are similar to the low color-shifting circuits C in the embodiment of FIG. 1A. When the third scan line S3 of the display device 300 receives the third scan signal from the scan driving unit S0, the low color-shifting switch $M_{b2}$ of the low color-shifting circuit C is turned on such that the second sub-pixel electrode $P_b$ of the second sub-pixel B is coupled to the compensating capacitor $C_c$ and that the liquid-crystal capacitor $C_{1b}$ shares charges with the compensating capacitor $C_c$. Accordingly, the brightness of the second sub-pixel B is decreased. When the fifth scan line S5 of the display device 300 receives the fifth scan signal from the scan driving unit S0, the low color-shifting switch $M_{b2}'$ of the low color-shifting circuit C' is turned on such that the fourth sub-pixel electrode $P_b'$ of the fourth sub-pixel B' is coupled to the compensating capacitor $C_c'$ and that the liquid-crystal capacitor $C_{1b}'$ shares charges with the compensating capacitor $C_e'$. Accordingly, the brightness of the fourth sub-pixel B' is decreased.

The main difference between the embodiments of FIG. 3 and FIG. 1A is directed to the black zone generation circuits D and D'. The black zone generation circuit D' is exemplary herein. The black zone generation circuit D' comprises a black zone switch $M_c'$. In the embodiment, the black zone switch $M_c'$ is a thin-film transistor, which has a gate coupled to the fourth scan line S4, a source/drain coupled to the second sub-pixel electrode $P_b$, and another source/drain coupled to the common node $V_{com}$. However, the invention is not limited to the above. The black zone switch $M_c'$ may be any device configured to selectively couple the second sub-pixel electrode $P_b$ to the common node $V_{com}$ according to the fourth scan signal of the fourth scan line S4. When the fourth scan line S4 receives the fourth scan signal, the black zone switch $M_c'$ of the black zone generation circuit D' is turned on such that the second sub-pixel electrode $P_b$ of the second sub-pixel B is coupled to the common node $V_{com}$ and that the data stored in the storage capacitor $C_{sb}$ is released. Accordingly, the second sub-pixel B becomes a black zone. Similarly, the black zone switch $M_c$ of the black zone generation circuit D is a thin-film transistor, which has a gate coupled to the second scan line S2, a source/drain coupled to a sub-pixel electrode of an upper adjacent pixel (not shown), and another source/drain coupled to the common node $V_{com}$.

Figure 4A:
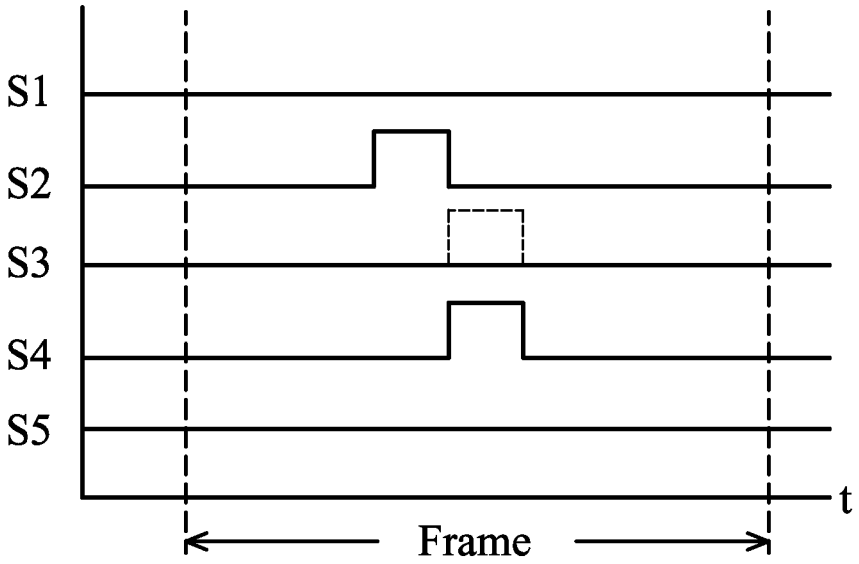
FIG. 4A is a diagram for illustrating a method for driving a display device according to an embodiment of the invention.
Figure 4B:
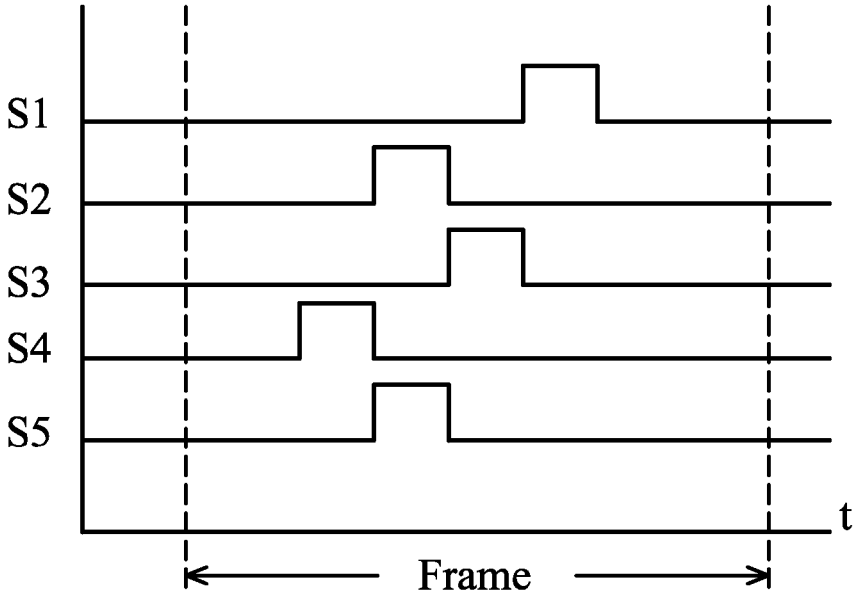
FIG. 4B is a diagram for illustrating a method for driving a display device according to another embodiment of the invention.

Two methods for driving the display device in FIG. 3 are disclosed as follows. Refer to FIGS. 4A and 4B. It is understood that the methods of FIGS. 4A and 4B correspond to the first scan line 51, the second scan line S2, the third scan line S3, the fourth scan line S4, and the fifth scan line S5 of the display device 300 in FIG. 3. The invention is not limited to the above. A person of ordinary skill in the art can easily apply these embodiments to another display device with any number of scan lines.

When the display device 300 operates in a 3D display mode, the method for driving is shown in FIG. 4A. In a frame period, the following steps are included. To begin, the second scan signal is output to the second scan line S2 such that the data of the data line Data is input to the storage capacitor $C_{sa}$ of the first sub-pixel A and the storage capacitor $C_{sb}$ of the second sub-pixel B. Next, the second scan signal is stopped, and the fourth scan signal is output to the fourth scan line S4. Accordingly, the data of the data line Data is input to the storage capacitor $C_{sa}'$ of the third sub-pixel A' and the storage capacitor $C_{sb}'$ of the fourth sub-pixel B', and the black zone switch $M_c'$ of the black zone generation circuit D' is turned on such that the second sub-pixel electrode $P_b$ of the second sub-pixel B is coupled to the common node $V_{com}$ and that the storage capacitor $C_{sb}$ of the second sub-pixel B is discharged until the transmittance of the liquid crystals of the second sub-pixel B becomes zero. The second sub-pixel B accordingly becomes a black zone. At the same time, the third scan signal may be selectively output to the third scan line S3 such that the low color-shifting switch $M_{b2}$ of the low color-shifting circuit C is turn on.

When the display device 300 operates in a 2D display mode, the method for driving is shown in FIG. 4B. In a frame period, the following steps are included. To begin, the fourth scan signal is output to the fourth scan line S4 such that the data of the data line Data is input to the liquid-crystal capacitor $C_{1a}'$ of the third sub-pixel A' and the liquid-crystal capacitor $C_{1b}'$ of the fourth sub-pixel B'. Next, the fourth scan signal is stopped, and the second scan signal and the fifth scan signal are output to the second scan line S2 and the fifth scan line S5, respectively. Accordingly, the data of the data line Data is input to the storage capacitor $C_{sa}$ of the first sub-pixel A and the storage capacitor $C_{sb}$ of the second sub-pixel B, and the low color-shifting switch $M_{b2}'$ of the low color-shifting circuit C' is turned on such that the fourth sub-pixel electrode $P_b'$ of the fourth sub-pixel B' is coupled to the compensating capacitor $C_c$ and that the liquid-crystal capacitor $C_{1b}'$ shares charges with the compensating capacitor $C_c$. Accordingly, the light output rate of the fourth sub-pixel B' is decreased, and the color-shifting effect for the display device 300 to display 2D image data is reduced. Note that the second scan signal and the fifth scan signal may be output at the same or different time. Then, the third scan signal is output such that the low color-shifting switch $M_{b2}$ of the low color-shifting circuit C is turned on and that the second sub-pixel electrode $P_b$ of the second sub-pixel B is coupled to the compensating capacitor $C_c$. Accordingly, the liquid-crystal capacitor $C_{1b}$ shares charges with the compensating capacitor $C_c$, and the light output rate of the second sub-pixel B is decreased.

The above display devices and methods for driving the same can be used to display 2D and 3D images. In the 2D display mode, the display device can reduce the color-shifting effect; in the 3D display mode, the display device turns off one of a first sub-pixel and a second sub-pixel to form a black zone such that crosstalk between the sub-pixels is reduced.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made to the invention. It is intended that the standard and examples be considered as exemplary only, with a true scope of the disclosed embodiments being indicated by the following claims and their equivalents.

What is claimed is:

1. A display device, comprising:
- a first scan line;
- a second scan line;
- a third scan line;
- a data line;
- a first pixel, comprising:
  - a first sub-pixel, comprising:
    - a first sub-pixel electrode; and
    - a first switch, receiving a second scan signal from the second scan line to selectively couple the data line to the first sub-pixel electrode; and
  - a second sub-pixel, comprising:
    - a second sub-pixel electrode; and
    - a second switch, receiving the second scan signal from the second scan line to selectively couple the data line to the second sub-pixel electrode;
- a low color-shifting circuit, comprising:
  - a compensating capacitor; and
  - a low color-shifting switch, receiving a third scan signal from the third scan line to selectively couple the compensating capacitor to the second sub-pixel electrode of the second sub-pixel; and
- a black zone generation circuit, receiving a black zone generation signal to couple the first sub-pixel electrode to a common node such that the first sub-pixel becomes a black zone;
- wherein the black zone generation circuit comprises a black zone switch having a control terminal, a first terminal, and a second terminal, wherein the control terminal is coupled to the first scan line, the first terminal is coupled to the first sub-pixel electrode, and the second terminal is coupled to the common node;
- wherein the display device further comprises:
- a scan driving unit, coupled to the first scan line, the second scan line, and the third scan line;
- wherein when the display device operates in a 3D (three-dimensional) display mode, the scan driving unit sequentially outputs the third scan signal, the second scan signal, and a first scan signal to the third scan line, the second scan line, and the first scan line, respectively, wherein the first scan signal is the black zone generation signal; and
- wherein when the display device operates in a 2D (two-dimensional) display mode, the scan driving unit sequentially outputs the first scan signal, the second scan signal, and the third scan signal to the first scan line, the second scan line, and the third scan line, respectively.

2. The display device as claimed in claim 1, wherein the black zone generation circuit further comprises a storage capacitor coupled between the second terminal and the common node.

3. The display device as claimed in claim 1, wherein the first switch, the second switch, and the low color-shifting switch are transistors.

4. A method for driving a display device as claimed in claim 1, wherein in a 3D (three-dimensional) display mode, the following steps are performed sequentially:
- outputting the third scan signal to the third scan line;
- outputting the second scan signal to the second scan line such that the data of the data line is input to the first sub-pixel and the second sub-pixel; and
- outputting a first scan signal to the first scan line, wherein the first scan signal is the black zone generation signal such that the first sub-pixel becomes the black zone.

5. The display device as claimed in claim 4, wherein in a 2D (two-dimensional) display mode, the following steps are performed sequentially:
- outputting the first scan signal to the first scan line;
- outputting the second scan signal to the second scan line such that the data of the data line is input to the first sub-pixel and the second sub-pixel; and
- outputting the third scan signal to the third scan line such that a liquid-crystal capacitor of the second sub-pixel shares charges with the compensating capacitor.

* * * * *